US011787015B2

(12) United States Patent
Da Silva Pedregal

(10) Patent No.: US 11,787,015 B2
(45) Date of Patent: Oct. 17, 2023

(54) CLAMPING ASSEMBLY

(71) Applicant: Melco International LLC, Westminster, CO (US)

(72) Inventor: Antonio Jose Da Silva Pedregal, Westminster, CO (US)

(73) Assignee: Melco International LLC, Westminster, CO (US)

( * ) Notice: Subject to any disclaimer, the term of this patent is extended or adjusted under 35 U.S.C. 154(b) by 48 days.

(21) Appl. No.: 15/931,861

(22) Filed: May 14, 2020

(65) Prior Publication Data

US 2021/0354269 A1 Nov. 18, 2021

(51) Int. Cl.
*B25B 5/06* (2006.01)
*B25B 5/02* (2006.01)

(52) U.S. Cl.
CPC . *B25B 5/06* (2013.01); *B25B 5/02* (2013.01)

(58) Field of Classification Search
CPC ..... B25B 5/064; B25B 5/163; B25B 5/04; B25B 5/06; B25B 11/00; B25B 5/062
USPC ..... 269/32, 237, 225, 243, 233
See application file for complete search history.

(56) References Cited

U.S. PATENT DOCUMENTS 1,197,639 A 9/1916 Kiewicz
3,664,288 A 5/1972 Weidlin Von Boden et al.
3,730,116 A 5/1973 Schramayr
4,449,463 A * 5/1984 Gilbride ..... D05B 39/00 112/305
4,455,952 A * 6/1984 Morin ..... D05B 31/00 112/102
4,644,881 A 2/1987 Schmidt et al.
4,770,401 A * 9/1988 Donaldson ..... B25B 1/18 269/283
4,831,753 A 5/1989 Inteso
4,934,844 A 6/1990 Orii
5,012,752 A 5/1991 Murata et al.
5,454,336 A 10/1995 Iwasaki
6,115,898 A * 9/2000 Sawdon ..... F16H 25/18 29/283
6,354,234 B2 3/2002 Wakasugi
6,679,190 B1 1/2004 French et al.
7,377,222 B1 * 5/2008 Moore, III ..... D05B 39/00
7,584,708 B1 9/2009 Viltrakis et al.
8,061,288 B2 11/2011 James et al.
(Continued)

FOREIGN PATENT DOCUMENTS

EP 1048772 11/2000
JP 61-106186 7/1986
(Continued)

OTHER PUBLICATIONS

Woodford, Chris. "Electric Motors" (Oct. 2, 2017), ExplainThatStuff.com (Year: 2017).*
(Continued)

*Primary Examiner* — Seahee Hong
(74) *Attorney, Agent, or Firm* — Volpe Koenig

(57) ABSTRACT

A workpiece clamping assembly includes a fixed member and a movable member and the movable member is associated with a motor for movement toward and away from the fixed member. The motor is in communication with a controller that selectively signals for movement of the movable members in response to an operator's command.

13 Claims, 8 Drawing Sheets

(56) References Cited

U.S. PATENT DOCUMENTS

| | | | | |
|---|---|---|---|---|
| 2001/0038175 | A1* | 11/2001 | Nagai | B25B 5/12 269/237 |
| 2002/0050117 | A1 | 5/2002 | Dasher et al. | |
| 2003/0130677 | A1* | 7/2003 | Whitman | A61B 17/072 606/167 |
| 2011/0315059 | A1* | 12/2011 | Lee | D05B 39/00 112/103 |
| 2012/0146275 | A1* | 6/2012 | Choi | B25B 5/06 269/226 |
| 2012/0222602 | A1 | 9/2012 | Hishida et al. | |
| 2013/0074748 | A1 | 3/2013 | Kato et al. | |
| 2017/0342619 | A1 | 11/2017 | Coombes | |

FOREIGN PATENT DOCUMENTS

| | | | |
|---|---|---|---|
| JP | 08-238391 | A | 9/1996 |
| JP | 11-151391 | | 6/1999 |
| JP | 2006-214016 | | 8/2006 |
| JP | 2017148180 | A * | 8/2017 |
| WO | 2002075031 | | 9/2002 |

OTHER PUBLICATIONS

Tsunekawa, Yuki; Shiina, Takayuki; Tamaki, Kyoichi. "Sewing Machine Translation". (Aug. 31, 2017). (Year: 2017).*

Singer Instruction Manual—Class 99 & 99K Sewing Machines, published by at least Feb. 1, 2001.

Ex Parte Reexamination Certificate for U.S. Pat. No. 7,377,222, issued May 10, 2019.

Website, Amazon.com—"Singer 01663 Stitch Sew Quick Portable Mending Machine, (Morgan)", URL: https://www.amazon.com/SINGER-Stitch-Portable-Mending-Machine/dp/B003BS34FG/ref=asc_df B003BS34FG/?tag=hyprod-20&linkCode=dflAhvadid=2307234306408thvpos=&hvnetw=g&hvrand=15703975253194763 74Thhvpone=8,hvptwo=&hvgmt=8,hvdev=c&hvdvcmd1=&hvlocint=&hvlocphy=9017746&hvtargid=pla338189069186&th=1; Retrieved Jul. 17, 2021, Dated Jun. 10, 2014 by PCT Authorized Officer.

* cited by examiner

CLAMPING ASSEMBLY

FIELD OF INVENTION

This invention relates to devices for clamping a workpiece in a desired position. More particularly, the invention relates to clamping a workpiece in a stitch applying machine. Most particularly, the invention relates to a device that enables selective clamping of a workpiece in an embroidering machine.

BACKGROUND

Clamping devices for holding a workpiece are known in the apparel industry and in related industries. The known devices are used for embroidering and monogramming a variety of workpieces including shirts, pants, sweaters, jackets, hats, handkerchiefs, towels and the like.

The known devices include manually operated devices where the user opens and closes the clamps by hand to position and hold the workpiece. In certain environments, manually-operated devices may be difficult to use. Additionally, manual actuation is time consuming and costly where high volume output is required, and manual operation of the clamp levers can result in overtightening which may lead to excessive wear and premature failure of the clamp or its parts. Furthermore, manual operation is undesirable where it is necessary for the user to have two hands available for holding the workpiece in position before clamping.

Pneumatically operated clamping systems are available. These pneumatic clamping systems typically use a compressor, which is often noisy and can involve piping which make them undesirable.

SUMMARY

In view of the known problems and disadvantages of prior manual and pneumatic devices, the present invention provides an efficient clamping assembly that utilizes a servo motor for opening and closing the clamp arms. The servo motor is actuated by a controller and the system incorporates a feedback system to warn against unsafe operation in the event a clamp is in the open position. This warning system also avoids damage to the embroidering machine in addition to possible operator injury. The operator control for the system may be wireless or wired, as is preferred. The system preferably includes a self-contained power pack to avoid the need for additional electrical cables around the equipment and improve portability.

BRIEF DESCRIPTION OF THE DRAWINGS

The invention will be described in conjunction with the following drawings in which like reference numerals designate like elements.

DETAILED DESCRIPTION OF THE PREFERRED EMBODIMENTS

Figure 1:
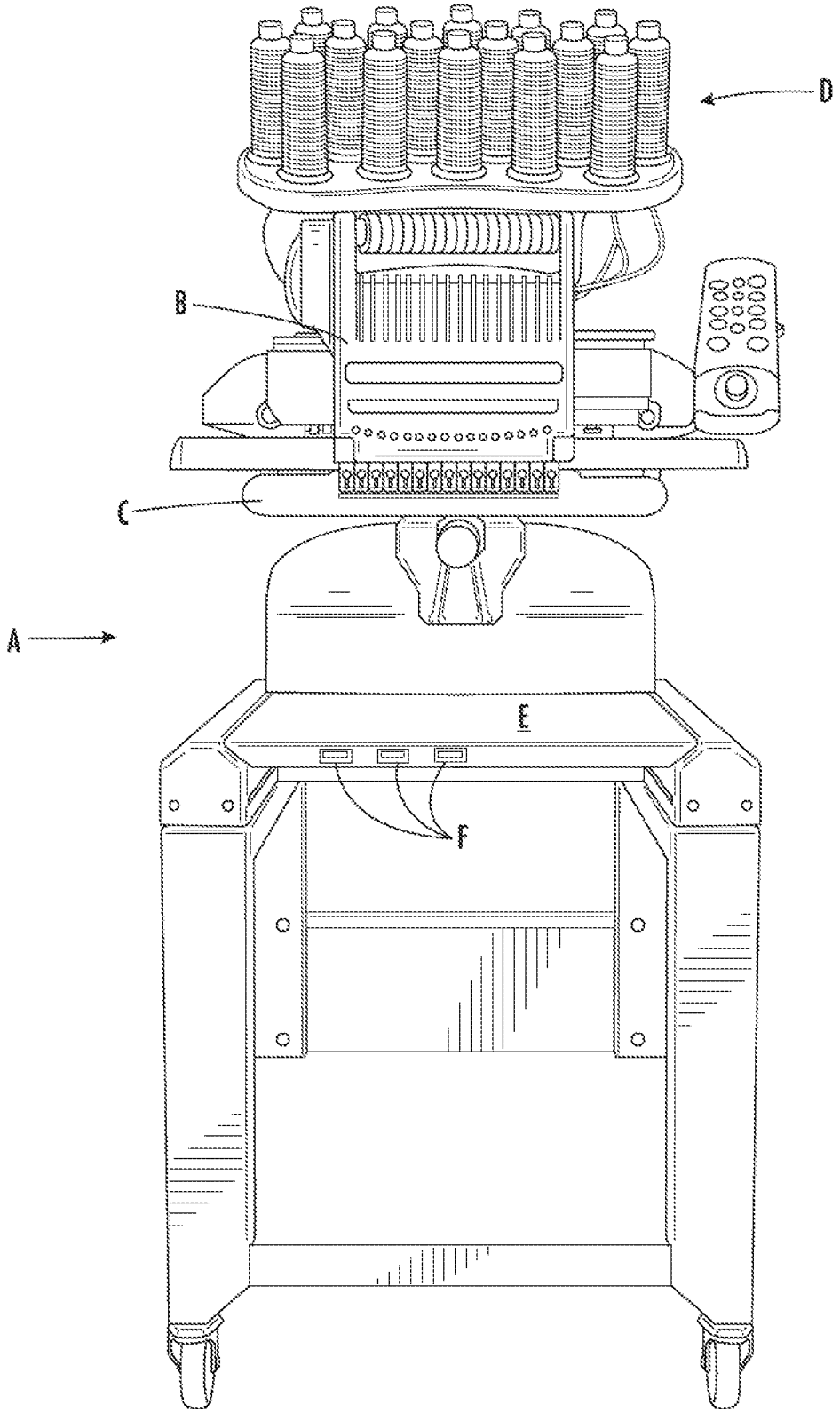
FIG. 1 is a perspective view of an embroidering machine.
Figure 2:
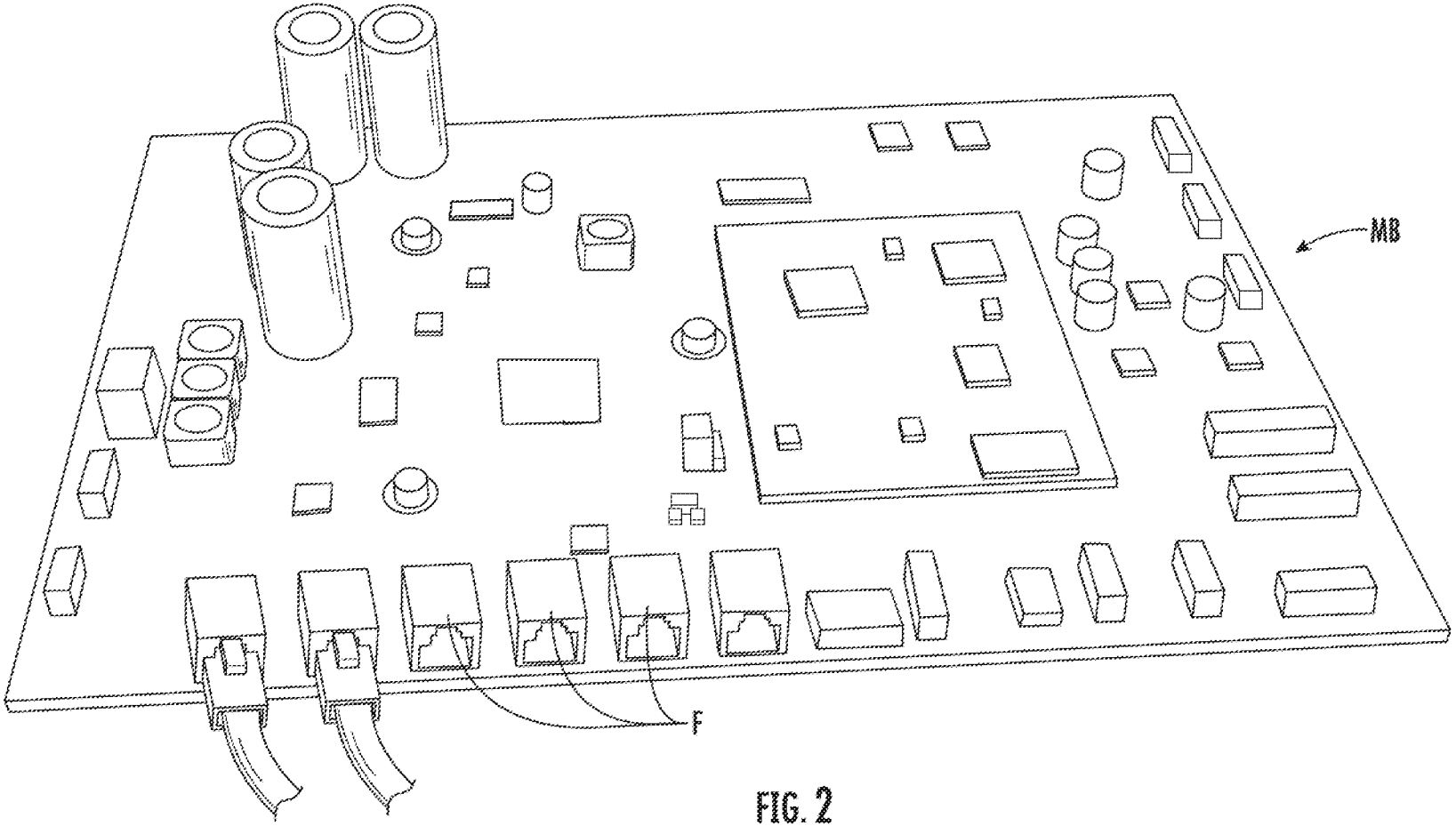
FIG. 2 illustrates a portion of a motherboard of the type associated with an embroidering machine like that in FIG. 1.

The environment for utilizing the present invention will be described with reference to FIGS. 1 and 2. Known embroidering machines, such as models EMT 16, ENT 16 Plus and EMT-X, which are available from Melco in Westminster, Colorado have a needle array "B", a carriage "C" and a thread supply "D." A removable cover E that overlies a motherboard, identified in FIG. 2 as MB, has been modified to provide access to a plurality of USB ports "F." With reference to FIG. 2, the motherboard "MB" control the operation of the needle array B during the embroidering operation and the additional USB ports "F" provide the interconnection between the clamping apparatus and the machine operation.

Figure 3:
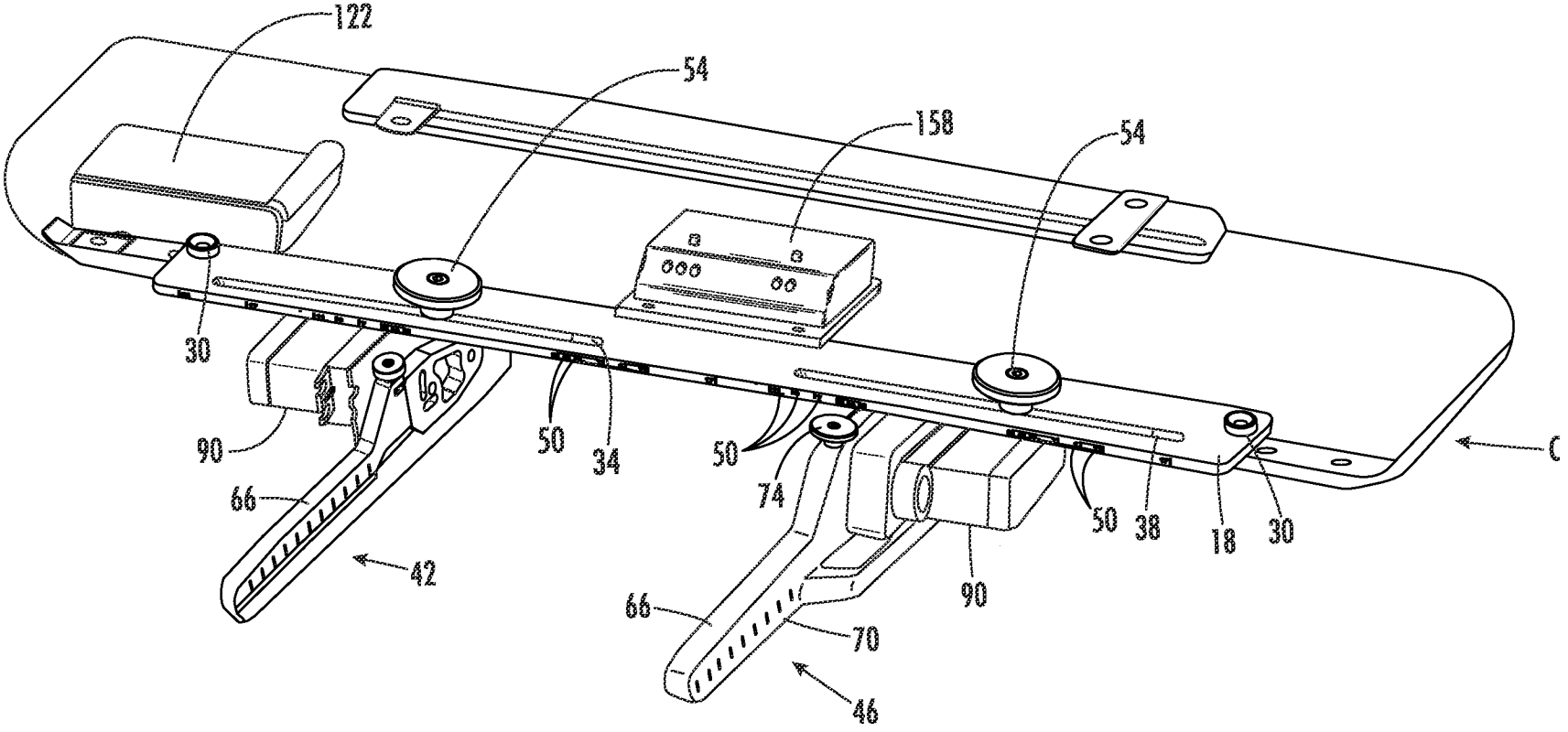
FIG. 3 illustrates a clamping apparatus according to the present invention attached to an existing part of an embroidering machine.

FIG. 3 illustrates the clamping apparatus 10 mounted on a carriage "C" that is show apart from the embroidery machine "A" for clarity. The support bracket 18 is attached to the carriage "C" with screws 30 in a mounting location for the positioning the clamping assemblies 42, 46 toward the operator and horizontally within the slots 34 and 38. The bracket 18 has elongated slots 34 and 38 for attaching the workpiece clamping assemblies 42 and 46 and spacing them according to the workpiece by threading the thumb screws 54 into the mounting block 58 as shown in FIG. 5.

Figure 4:
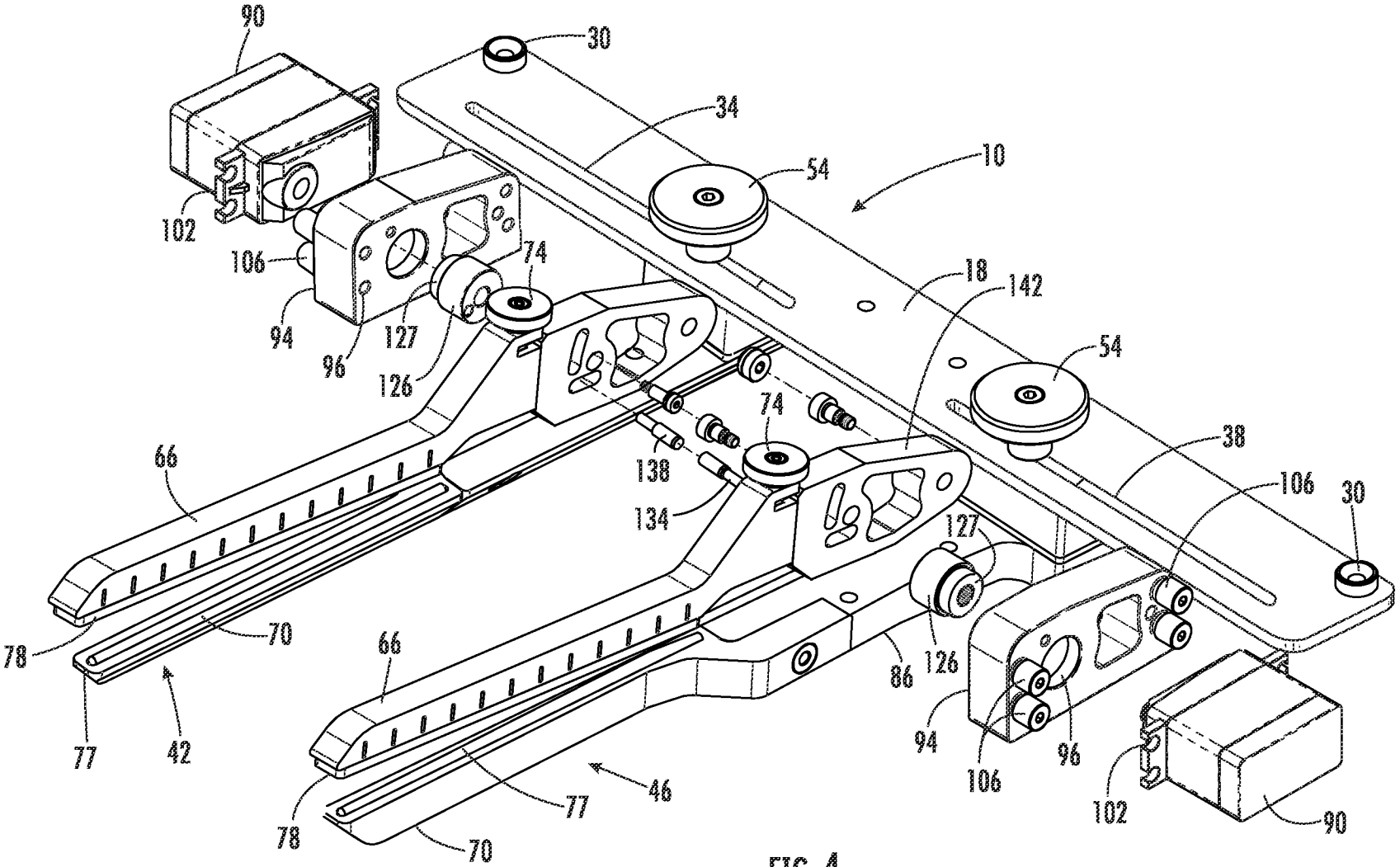
FIG. 4 is an exploded view of the clamping apparatus in FIG. 3 as it appears when separated from the embroidering machine.

With reference to FIG. 4, an elongated mounting block 86 extends toward an operator position and is connected to the base of the mounting block 58. Mounting blocks 58 and 86 may be made as a single block but it is currently preferred to make them individually so size adjustments can be made in either mounting block. In addition, the mounting block 86 has a relief or cut portion where the lower arm 70 can be connected so it is vertically aligned with the upper arm 66 without any sacrifice of strength in the remaining mounting block 86. A third mounting block 94 is secured to the elongated mounted block 86. The mounting blocks 58, 86 and 94 form the basic structure that is carried by the bracket 18 for mounting the clamping components.

Figure 5:
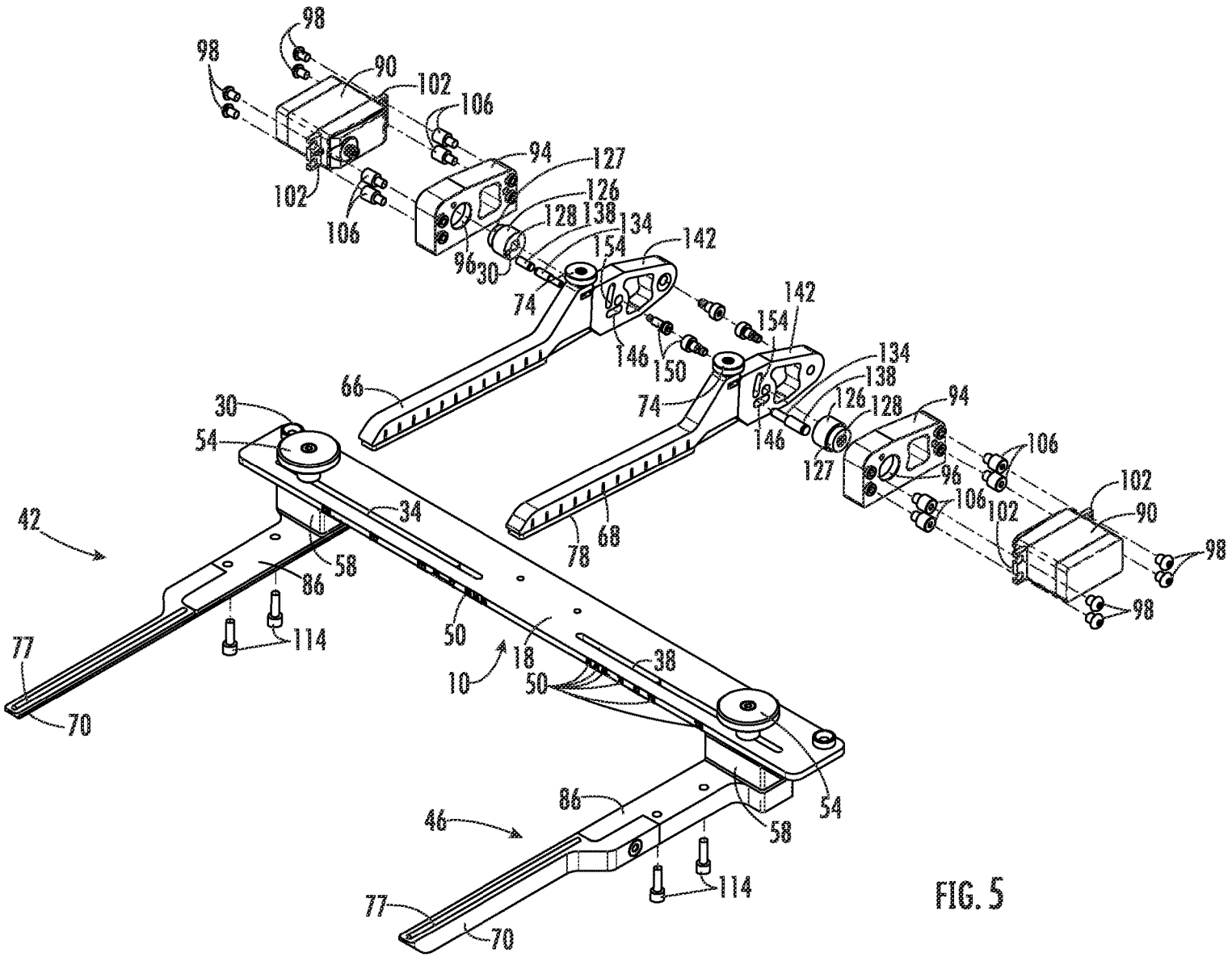
FIG. 5 is a further exploded view of the clamping apparatus in FIG. 4.
Figure 6:
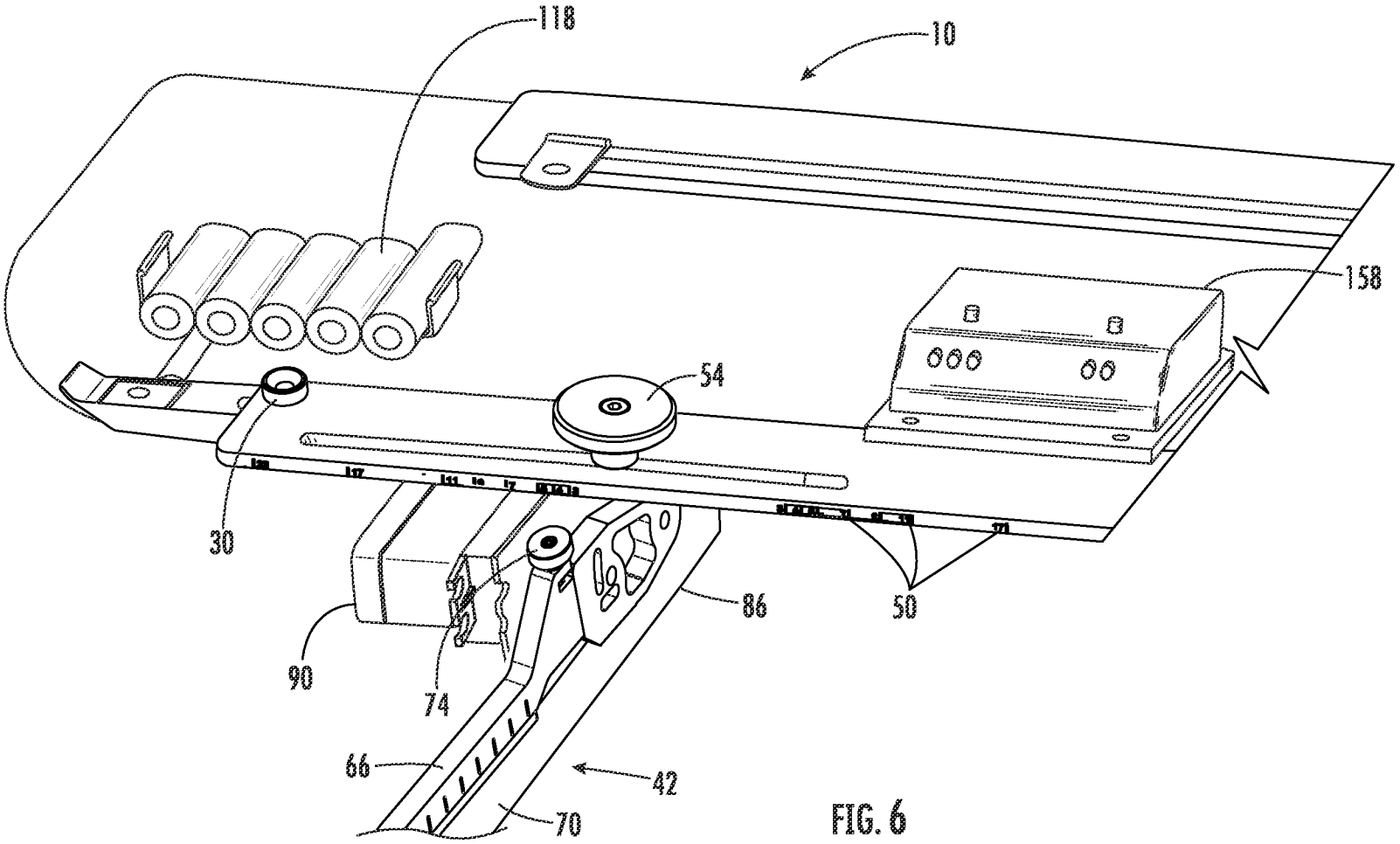
FIG. 6 is an enlarged view of the portion identified as 6 in FIG. 3.

With reference to FIGS. 3-5, the clamping arm assembly 42 and the clamping arm assembly 46 preferably have lower arms or jaws 70 that are mirror images of each other and identical upper arms or jaws 66. The projected length of the lower arms 70 and upper arms 66 can be varied in length depending upon the location of the carriage "C" and or the needs for a given workpiece.

With reference to FIG. 3, the forward or operator facing edge of the bracket 18 has a plurality of position markers 50. The position markers 50 are aligned with depressions on the bottom surface of the bracket 18. When a clamp arm assembly 42, 46 passes over a position marker 50, there is an auditable clicking sound to aid in conveniently and accurately positioning the claiming assemblies along the slots 34 and 38 according to the workpiece.

The upper arm 66 is typically designated as the arm moveable that moves vertically between opened and closed positions for clamping a workpiece against a typically stationary lower arm 70 or releasing a workpiece.

Figure 8:
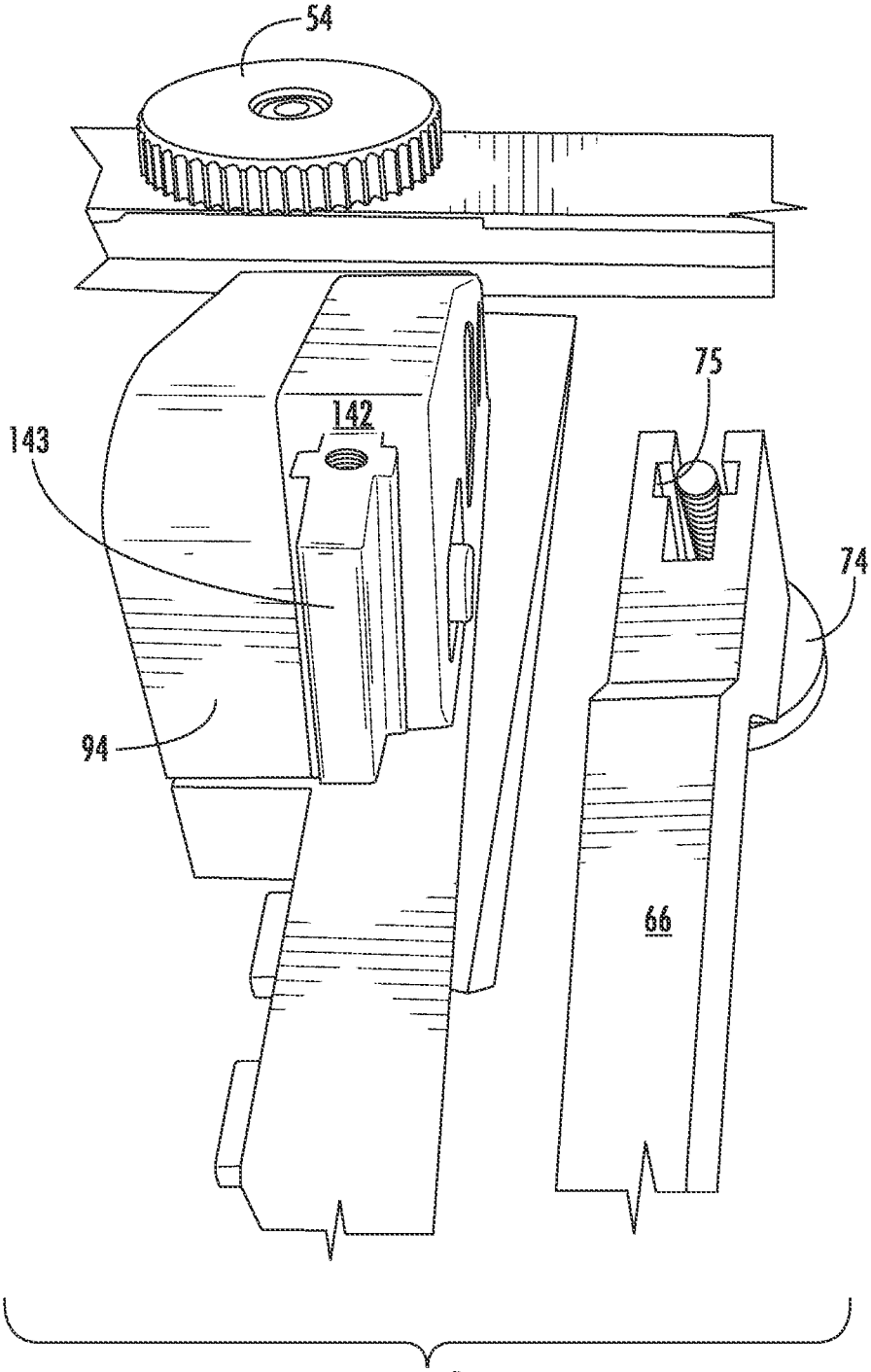
FIG. 8 illustrates the connection and adjustment of the upper and lower arms of the clamping assembly.

The movable upper arm 66 receives a thumb screw 74, see FIGS. 3-5, for adjusting the upper arms 66 at a desired height, based upon the material's thickness, to define the space for holding the workpiece in place. Turning the height adjustment thumb screw 74 clockwise threads the screw 74 in to the mounting block 142 and lowers the upper clamp arm 66; turning counterclockwise raises the upper arm 66. By utilizing the thumb screw 74, an operator can determine the gap in the closed position. The interconnection between the upper arm 66 and the mounting block 142 is illustrated in FIG. 8. As illustrated in FIG. 8, the mating fit "T" shaped portions 75 and 143 provides a stable connection in two planes while the screw 74 accounts for adjustments in a third plane.

To further aid in retaining a workpiece without damaging it, one of the arms 66 and 70 has a compressible strip 78 to make contact with the workpiece and the other arm has an opposing raised and elongated bead 77 of a generally non-compressible material, such as silicone to make contact and secure the workpiece against movement. The upper arms 66 are also provided with a plurality of equally hash marks 68 to serve as a depth guide to facilitate proper orientation of the workpiece within the clamping assemblies 42, 46.

Referring now to FIG. 4, the motor mounting block 94 is mounted to the lower clamp arm mounting block 86 using suitable hardware, such as screws 114. Preferably, a servo motor 90 is mounted to block 94 for operation of the movable upper arm 66 in each clamp arm assembly 42, 46. As best shown in FIGS. 4 and 5, each mounting block 94 has threaded bores that receive the internally threaded spacers 106 and align with the flanges 102 on the housing of servo motor 90. Screws 98 thread into the pillars or spacers 106 and hold the motor 90 in position on mounting block 142 for actuation of the movable arm 66. A presently preferred servo motor is the Miuezth 25 KG 270 Degree High Torque RC Digital Servo.

While the motors 90 may be powered by an available electric line power supply, it is currently preferred to use battery power, which improves portability between machines. As illustrated in FIG. 2, the battery power source 118 is a 2000 mAh battery pack comprises of a plurality of batteries arranged in parallel. The housing 122 for power source 118 is preferably attached to the carriage "C" or bracket 18 using suitable hardware to avoid additional power cable and provide portability.

Each motor 90 has limited clockwise and counter-clockwise rotational movement that moves the upper arm 66 between the desired raised and lowered positions. As best seen in FIGS. 4 and 5, the bearing 126 has a reduced portion 127 that fits within the through opening 96 in mounting block 94 and has a central opening 128 that receives the armature of the servo motor 90. As best illustrated in FIGS. 4 and 5, the pin 134 engages the oblong race 146 in mounting block 142. The pin 134 is within the bearing 126 and that carries a rotatable roller 138, which is preferably made of brass. The clockwise and counterclockwise movements of the servo motor 90 will cause rotation of the bearing 126, which in turn will cause the pin 134 and roller 138 to move within the horizontal race 146 and move the upper arm 66 between open and closed positions. A shoulder screw 150 that extends through slot 154 located in the upper clamp arm mounting block 142 is connected to the mounting block 94 and limits lateral movement of the upper clamp arm 66 with respect to the lower clamp arm 70.

The various mounting blocks are preferably separate assembled components for ease of manufacturing, but they may be formed as a one piece.

Figure 7:
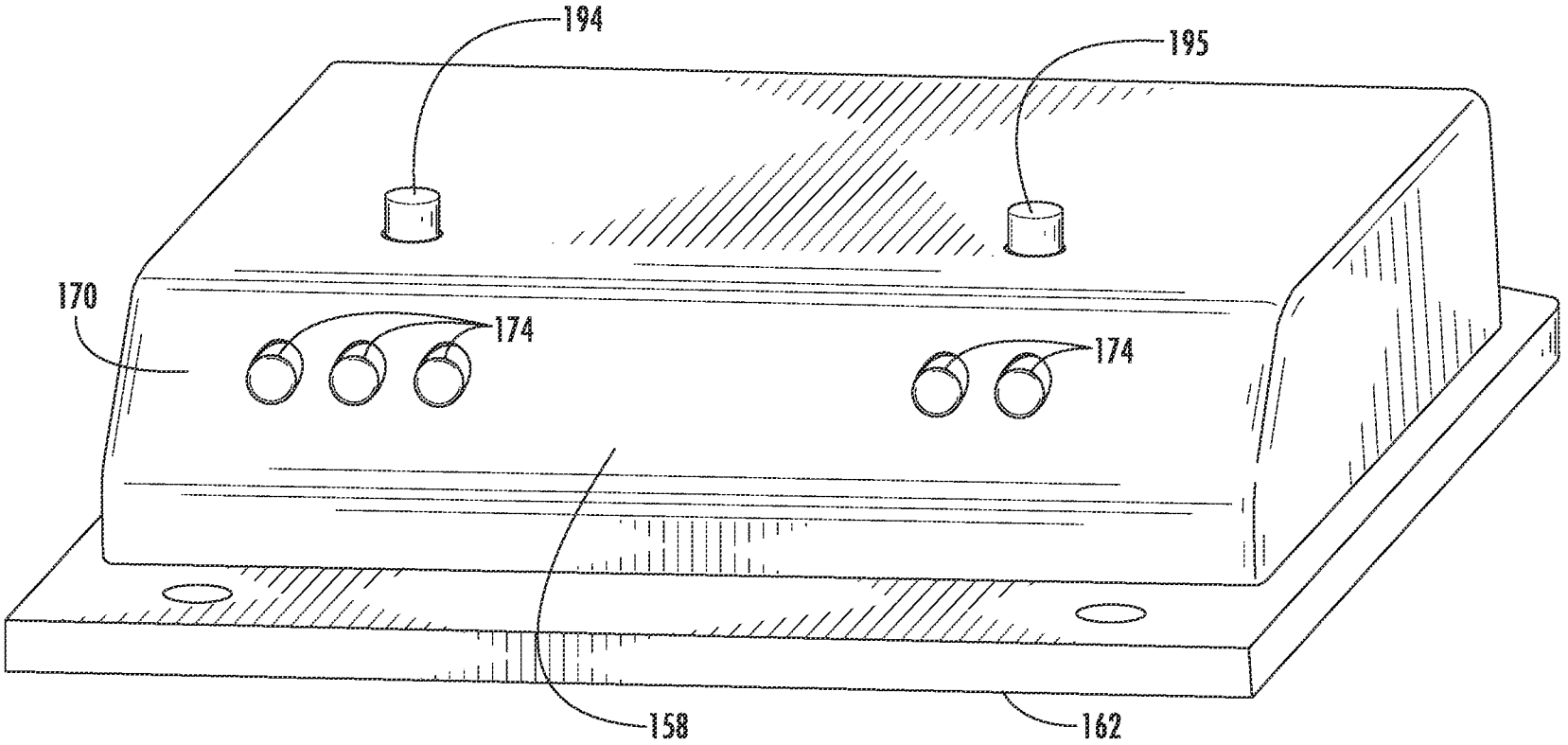
FIG. 7 is an enlarged view of the control device in FIG. 3.

With reference to FIGS. 3, 4 and 7, a control unit 158 for the present invention is illustrated. The illustrated unit has a mounting flange 162 attached to the housing 122 so it can be mounted preferably on the bracket 18 but alternatively on the carriage "C" with suitable fasteners or screws. Depending on the mounting location, a power cable with extend between the housing 122 and the control unit 158. In the event an available electric supply is used the power cable will need to be configured accordingly.

The front panel 170 of control unit 158 has a plurality of LED status lights 174 that, in this configuration, are labeled "Left", "Right", "Both", "On", and "Pairing." The "Left", "Right", and "Both" lights to correspond with either a sequential or a simultaneous operation of the clamp arm assemblies 42 and 46. The "On" and "Pairing" LEDs are associated with pairing or establishing a wireless connection between a foot pedal and the control unit 158.

One suitable pedal is a potentiometer type pedal that responds to the pressure and speed applied by the operator's foot is available from Bernina or a Hall Effect encoder which is readily available. The pedal may be connected to the motherboard "MB" by a USB cable connected to one of the USB ports "F" or wireless by placing an associated dongle in one of the USB ports "F." In this latter case, the foot pedal is battery operated.

While a hard-wired connection between the foot pedal and the motherboard "MB" is preferred, the control unit 158 may also be connected wireless using the plurality of USB ports.

The control unit 158 has a plurality of buttons 194 and 195 for operational selections. Each time the button 194 is depressed, the control unit 158 toggles between "Left," "Right," and "Both" LEDs to control which of the clamp arm assemblies 42 and 46 is activated. With the current servo motor 90, it takes approximately 0.5 seconds to operate an upper arm 66. Once both clamp arm assemblies are locked in place, the information is provided to the embroidering machine to permit embroidering to begin.

When the workpiece is in place, the assemblies are activated by the operator, such as with a foot pedal, which is current preferred because it leaves the operator's hand free. The preferred pedal has a potentiometer, like a Hall Effect sensor, that provides feedback to the control unit 158. As the pedal is depressed from 0% to about 80% of a fully depressed position, it produces progressive movement of one or both upper arms 66. The approximately remaining 20% of pedal movement is reserved to confirm that the pedal has been fully depressed. Once the foot pedal is fully depressed for a predetermined period of time, between 0.2, and 0.5 seconds, the clamping arms are locked in place. If it is necessary for the user to readjust the material held within the clamp arm assemblies 42, 46, the operator can actuate the foot pedal 182 multiple times in rapid succession to unlock one or both clamp arms 66.

Once the machine embroidery operation commences, the motherboard MB sends a lock signal to the control unit 158. The control unit or controller 158 preferably also has a gyroscope that detects movement and signals the control unit to lock down. This is a preferred safety feature in case communication between the motherboard and the controller is lost. At the end of the design execution, there will be an unlock signal from the motherboard and, if desired, it could be coupled with automated opening of the clamps. The motherboard will preferably execute this command and not the gyroscope because the machine may be idled for other reasons, such as a thread break or an operator does not intervene in time, which could confuse the gyroscope.

Once the clamp arm assemblies 42 and 46 are closed on the workpiece, the workpiece is held in place mechanically by the camming action and power to the servo motors 90 may be removed to preserve power. Power can be restored to the motors 90 to open the clamp arm assemblies 42 and 46 on a signal from the motherboard. This is similar to the intelligent door lock systems Bolt locks in vehicles where a single signal from the remote key moves the mechanism between locked and unlocked positions and stays in selected position until a change is commanded.

Sequential operation of the left and right clamp arm assemblies 42 and 46 may be desirable for certain types of workpieces. For example, when embroidering a dog collar or belt, an operator may choose to first clamp one side of the workpiece at a predetermined depth and then position the opposite side of the within at the corresponding hash mark to assure proper orientation prior to clamping and embroidering.

In other cases, it may be desirable to stretch the workpiece prior to embroidering. Sequential operation of the left and right clamp arm assemblies 42, 46 enables clamping of one side of the workpiece then straightening and stretching the workpiece prior to clamping the opposite side.

What is claimed is:

1. A battery powered, motor operated workpiece holding assembly for an embroidery machine, the workpiece holding assembly comprising:

a carriage mountable in the embroidery machine;

a support bracket attached to the carriage;

a pair of mounts;

a pair of fasteners for connecting each of the mounts to the support bracket;

a first pair of clamping jaws attached to the support bracket, each clamping jaw of the first pair of clamping jaws is attached to a respective mount;

a second pair of clamping jaws attached to the support bracket, each clamping jaw of the second pair of clamping jaws is movably attached to a respective mount in vertical opposition to the clamping jaw of the first pair of clamping jaws attached to the respective mount; and, a pair of servo motors attached to the support bracket, each servo motor is attached to a respective mount and activates a respective one of the second pair of clamping jaws via rotational movement of a pin within a race defined in a mounting block attached to the respective clamping jaws of the second pair of clamping jaws, wherein the race has an oblong profile in a lateral direction;

a controller supported on the carriage that selectively activates each of the pair of motors for movement of the second pair of clamping jaws; and a self-contained battery pack supported on the carriage that powers each respective motor and the controller.

2. The assembly of claim 1 wherein, the controller independently activates the respective motor.

3. The assembly of claim 1 wherein, the controller terminates power to the respective motor after the second pair of the clamping jaws is in the clamping position.

4. The clamping assembly of claim 1, wherein the pin is configured to traverse the race in the lateral direction.

5. A clamping assembly in combination with an embroidery machine, the combination comprising:

the embroidery machine having:

a needle array;

a thread supply;

a control unit;

a workpiece embroidery position; and, a motherboard with at least one Universal Serial Bus (USB) port, and, a workpiece holding assembly having:

a carriage mounted to the embroidery machine;

a support bracket attached to the carriage;

a pair of mounts;

a pair of fasteners for connecting each of the mounts to the support bracket;

a first pair of clamping jaws attached to the support bracket, each clamping jaw of the first pair of clamping jaws is attached to a respective mount;

a second pair of clamping jaws attached to the support bracket, each clamping jaw of the second pair of clamping jaws is movably attached to a respective mount in vertical opposition to the clamping jaw of the first pair of clamping jaws attached to the respective mount; and, a pair of servo motors attached to the support bracket, each servo motor is attached to a respective mount and activates a respective one of the second pair of clamping jaws via rotational movement of a pin within a race defined in a mounting block attached to the respective clamping jaws of the second pair of clamping jaws, wherein the race has an oblong profile in a lateral direction;

a controller supported on the carriage that selectively activates each of the pair of motors for movement of the second pair of clamping jaws; and a power source supported on the carriage powers each of the respective motors and the controller.

6. The clamping assembly of claim 5, wherein the control unit acts in response to commands from an operator control.

7. The clamping assembly of claim 6, wherein commands between the operator control and the control unit are transmitted wirelessly.

8. The clamping assembly of claim 5, wherein the controller has a plurality of modes.

9. The clamping assembly of claim 8, wherein the plurality of modes include sequential and simultaneous movement of the at least two spatially arranged clamps.

10. The clamping assembly of claim 8, wherein said control unit includes a display that indicates each of the respective modes among the plurality of modes.

11. The clamping assembly of claim 5, wherein the control unit terminates power to the respective motor after the associated clamps is in the clamping position.

12. The clamping assembly of claim 5, wherein the controller is configured to lock the at least two spatially arranged clamps in position when an operator control is engaged.

13. The clamping assembly of claim 5, wherein the controller is configured to issue a warning signal when either clamp of the at least of the two spatially arranged clamps is in an opened position.

* * * * *